United States Patent [19]

Inoue et al.

[11] Patent Number: 4,684,236

[45] Date of Patent: Aug. 4, 1987

[54] TONER CONCENTRATION DETECTING DEVICE FOR DRY TYPE ELECTROGRAPHIC COPY MACHINE

[75] Inventors: Yoshio Inoue; Matsuyuki Aoki, both of Kanagawa, Japan

[73] Assignee: Fuji Xerox Co., Ltd., Tokyo, Japan

[21] Appl. No.: 887,985

[22] Filed: Jul. 25, 1986

Related U.S. Application Data

[63] Continuation of Ser. No. 583,475, Feb. 24, 1984, abandoned.

[30] Foreign Application Priority Data

Mar. 10, 1983 [JP] Japan ..... 58-38139

[51] Int. Cl.[4] ..... G03G 15/08

[52] U.S. Cl. ..... 355/3 DD; 355/14 D; 118/691

[58] Field of Search ..... 355/3 DD, 14 D; 118/688, 689, 690, 691; 356/440

[56] References Cited

U.S. PATENT DOCUMENTS

| | | | |
|---|---|---|---|
| 3,897,748 | 8/1975 | Hirata et al. | 118/691 |
| 3,928,764 | 12/1975 | Bock et al. | 118/690 X |
| 4,419,960 | 12/1983 | Okamura et al. | 118/691 X |

*Primary Examiner*—Arthur T. Grimley
*Assistant Examiner*—J. Pendergrass
*Attorney, Agent, or Firm*—Sughrue, Mion, Zinn, Macpeak, and Seas

[57] ABSTRACT

In a toner concentration detecting device wherein developer is carried by a roll from a developer flowpath to a detection station for optical detection thereof, a restriction element is provided adjacent the roll between the developer flowpath and detection station to limit the thickness of the developer adhered to the roll. A scraper is provided downstream of the detection station for cleaning the roll, and the roll itself is covered with a non-magnetic material to provide a substantially smooth outer surface.

7 Claims, 2 Drawing Figures

TONER CONCENTRATION DETECTING DEVICE FOR DRY TYPE ELECTROGRAPHIC COPY MACHINE

This is a continuation, of application Ser. No. 583,475, filed Feb. 24, 1984, now abandoned.

FIELD OF THE INVENTION

The present invention relates to a device for detecting the concentration of two-component toner or developer in a dry type electrographic copying machine.

DESCRIPTION OF THE PRIOR ART

A conventional toner concentration detecting device of the kind mentioned above is arranged as shown in FIG. 1.

An aluminum roll 02 is pivotally supported adjacent to a magnetic roll 01 which operates as a developer carrying member. A permanent magnet 03 is embedded in a portion of the roll 02. A piece of electrically conductive glass 04 having a cylindrically curved inner surface coaxial with the roll 02 is provided adjacent to the roll 02. The conductive glass 04 is provided with a lamp 05 for radiating light onto the cylindrically curved inner surface of the glass 04 and with a light receiving element 06 for receiving the light reflected from the roll 02 or the permananent magnet 03 to measure the amount of the received light.

In the conventional toner concentration detecting device as shown in FIG. 1, developer 07 on the magnetic roll 01 is attracted to the permanent magnet 03, and a value corresponding to the toner concentration contained in the developer 07 attracted to the permanent magnet 03 is measured by the light receiving element 06.

In detecting toner concentration, a voltage is applied across the roll 02 and the conductive glass 04, the toner of the developer 07 is devloped on the conductive glass 04, light is caused to pass through the developer 07 existing between the conductive glass 04 and the roll 02 or the permanent magnet 03 so as to be reflected by the roll 02 or the permanent magnet 03, and the amount of light reflected by the roll 02 or the permanent magnet 03 is measured through the output of the light receiving element 06. Subsequently, a voltage of opposite polarity is applied to the roll 02 and the conductive glass 04 and the amount of light reflected by the roll 02 or the permanent magnet 03 is measured through the output of the light receiving element 06 under the condition that there exists no developer 07 between the roll 02 and the conductive glass 04. Thus, the toner concentration is detected from the difference between the two measured values.

In such a conventional toner concentration detecting device, however, since the developer 07 is attracted onto the permanent magnet 03 by the magnetic force of the permanent magnet 03 from the magnetic roll 01 carrying the developer 07, there may occur variations in thickness of the developer attached onto the permanent magnet 03 and hence inequality in density of the developer 07 per unit volume, resulting in low accuracy in detection.

Even if the developer 07 is attached with a substantially predetermined thickness onto the magnetic roll 01 and attracted to the permanent magnet 03 from the magnetic roll 01 at a position where the roll 01 is uniformly transporting the developer 07 to a photosensitive body, the accuracy in detection is low due to the reasons described above. Further, it is impossible to provide the toner concentration detecting device at a position, such as in the vicinity of a paddle, where the amount of transportation of the developer 07 is not uniform, thus resulting in a significant restriction in the mounting position of the device.

Further, since the developer 07 for the toner concentration detection is sampled from the magnetic roll 01 which is being used to carry the developer to a photosensitive body, the development of toner onto the photosensitive body may be affected to some degree.

Still further, since the developer 07 attached to the roll 02 is removed or cleaned by a so-called rubbing phenomenon by the developer 07 on the magnetic roll 01, the cleaning of the roll 02 is sometimes insufficient, resulting in an error factor in toner concentration detection.

SUMMARY OF THE INVENTION

An object of the present invention is therefore to provide an improved toner concentration detecting device for a dry type electrographic copying machine in which the problems in the prior art are overcome.

Another object of the present invention is to provide a toner concentration detecting device in which the thickness of the developer on the circumferential periphery of the detection roll is made uniform and in which the circumferential periphery of the roll is cleaned, so that the errors are reduced and the detecting accuracy is enhanced.

According to the present invention, in a toner concentration detecting device comprising a roll which rotates in a developing device while being in contact with or approaching developer in the flow path of the developer, a permanent magnet provided at a portion of the roll, a piece of electrically conductive glass provided in opposition to the circumferential peripheral surface of the roll, and means for optically detecting the concentration of the developer formed on the conductive glass by the permanent magnet, a restriction member for restricting the amount of developer attached onto the roll is provided so that the amount of developer attached to the roll can be made uniform to improve the accuracy in detection.

DESCRIPTION OF THE PREFERRED EMBODIMENT

Figure 1:
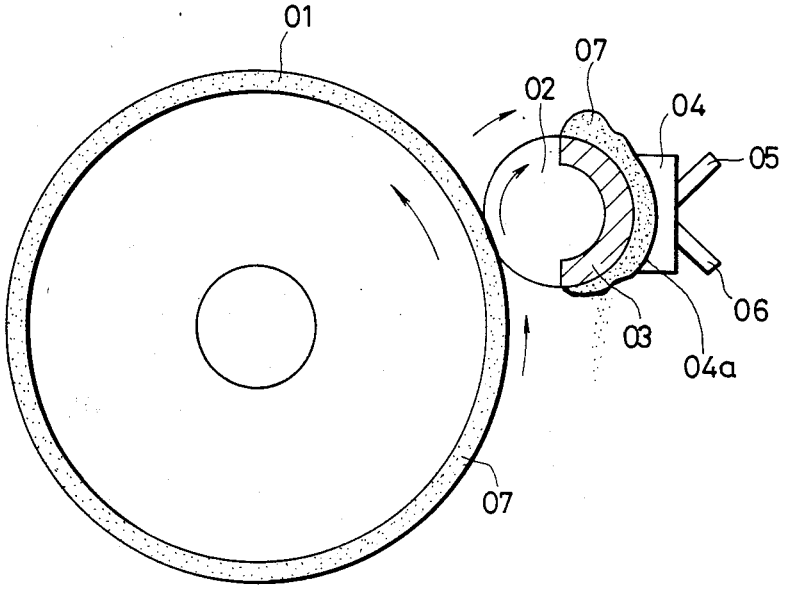
PRIOR ART FIG. 1
FIG. 1 is a schematic side view of a conventional toner concentration detecting device for the dry type electrographic copying machine.
Figure 2:
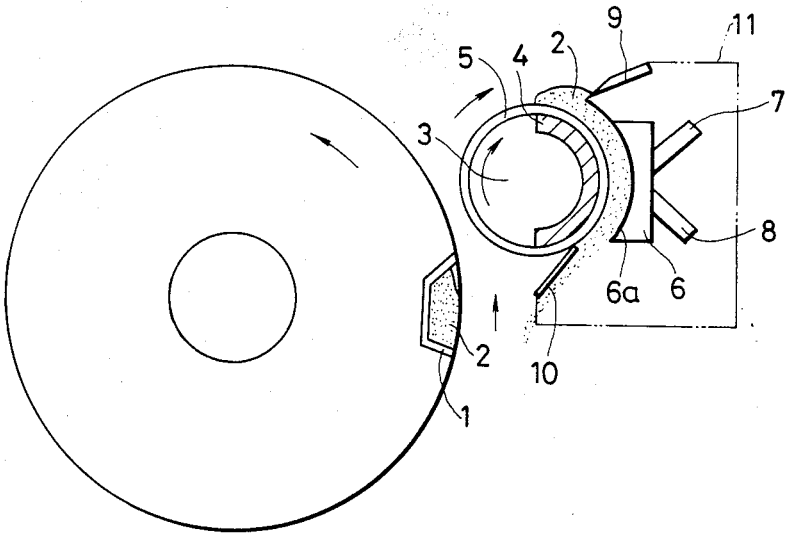
FIG. 2 is a schematic side view of the toner concentration detecting device for the dry type electrographic copying machine according to an embodiment of the present invention.

Referring to FIG. 2, an embodiment of the present invention will now be described.

A paddle 1 which serves as a developer transporting member and which is supported in a housing (not shown) of the developing device is driven by an electric motor (not shown) or the like to rotate counterclockwise in the drawing and to scoop developer 2 in the abovementioned housing and transport the scooped developer 2 to a magnetic roll (not shown) in a known manner.

Adjacent to the right side of the paddle 1, a detection roll 3 made of an aluminum material is supported for clockwise rotation in opposition to the paddle 1. A permanent magnet 4 is integrally embedded in the roll 3, and the outer periphery of the roll 3 with the embedded permanent magnet is fitted with a sleeve 5 made of a white glossy aluminum material.

An electrically conductive glass 6 formed with a cylindrically curved inner surface 6*a* coaxial with the roll 3 is provided adjacent to the sleeve 5. The conductive glass 6 is provided with a lamp 7 which radiates light to the cylindrically curved inner surface 6*a* of the conductive glass 6 and a light receiving element 8 for receiving the light reflected from the sleeve 5 to measure the amount of the received light. The conductive glass 6 together with the lamp 7 and detector 8 form a detection station.

Above the sleeve 5, a restriction plate 9 is supported by a support member 11 with a predetermined distance between the forward end thereof and the circumferential periphery of the sleeve 5. Below the sleeve 5, a developer scraping plate 10 is supported by the support member 11 with the forward end thereof in close contact with the circumferential periphery of the sleeve 5.

A DC voltage is applied between the sleeve 5 and the conductive glass 6 with the polarity changed alternately.

Since the embodiment illustrated in FIG. 2 is arranged as described above, the permanent magnet 4 may pass adjacent to the paddle 1 at a time when the paddle 1 approaches the sleeve 5 and the developer 2 in the paddle 1 is attracted onto the sleeve 5 by the magnetic force of the permanent magnet 4. The developer 2 attracted onto a part of the surface of the sleeve 5 adjacent to the permanent magnet 4 is smoothed by the restricting plate 9 and is transported to a space between the sleeve 5 and the cylindrically curved inner surface 6*a* of the conductive glass 6.

Little developer 2 exists at a portion of the surface of the sleeve 5 which is not adjacent to the permanent magnet 4, because the influence of the permanent magnet 4 on that portion is small.

Accordingly, the developer 2 is intermittently transferred to the space between the sleeve 5 and the conductive glass 6 once per one revolution as the sleeve 5 rotates. Since the DC voltage applied acros the sleeve 5 and the conductive glass 6 is changed in polarity alternately every several revolutions of the sleeve 5, the condition in the space between the sleeve 5 and the conductive glass 6 alternately changes.

When a voltage is applied across the sleeve 5 and the conductive glass 6 with such a polarity that the toner in the developer 2 can be developed onto the cylindrically curved inner surface 6*a* of the conductive glass 6, the toner in the developer 2 existing between the sleeve 5 and the conductive glass 6 is attracted onto the cylindrically curved inner surface 6*a* of the conductive glass 6 and the measured value corresponding to the amount of the developed toner can be obtained by the light receiving element 8.

When a voltage of the opposite polarity is applied across the same components, the toner is not developed on the cylindrically curved inner surface 6*a* of the conductive glass 6 and a measured value higher than that obtained in the developed state as described above can be obtained by the light receiving element 8.

Thus, a low-level AC measured value is obtained as the sleeve 5 rotates in the state where toner is developed on the cylindrically curved inner surface 6*a* of the conductive glass 6, while a high-level AC measured value is obtained in the state where no toner is developed on the cylindrically curved inner surface 6*a*, so that the toner concentration can be detected through comparison between the two measured values.

Since the developer 2 can be uniformly transferred to the space between the sleeve 5 and the cylindrically curved inner surface 6*a* of the conductive glass 6 by the help of the restriction plate 9, high detection accuracy can be obtained.

Further, since the developer 2 on the sleeve 5 is made even by the restriction plate 9, it is not necessary to sample the developer from the magnetic roll, so that not only does the magnetic roll remain unaffected, but also the mounting place of the detecting device can be freely selected.

Furthermore, since the developer 2 on the sleeve 5 can be scrapped by the developer scraping plate 10 to clean the surface of the sleeve 5, the measurement by the light receiving element 8 in the non-development state can be accurately performed, with reduced measurement error.

Moreover, since the outer periphery of the integrated detection roll 3 and permanent magnet 4 is covered with the sleeve 5, even if there is a gap or a stepped portion between the roll 3 and the permanent magnet 4, the scraping plate 10 will not damage the roll 3 or the permanent magnet 4 by catching the same by the forward end thereof.

In the toner concentration detecting device according to the present invention, since the cleaning member is provided, the outer circumferential surface of the roll can be cleaned so that the detection error can be remarkably reduced.

We claim:

1. In an electrophotographic copying machine wherein developer is carried along a flowpath, a toner concentration detecting device comprising:

a detection roll carrying a magnet for attracting developer onto said detection roll and rotating adjacent said flowpath, wherein a light reflecting sleeve is disposed upon the outer periphery surface of said detection roll, and a detection station adjacent said detection roll for detecting the amount of toner in the developer carried from said flowpath to said detection station by said detection roll, said detecting device further comprising restriction means adjacent said detection roll between said flowpath and upstream of the detection station for restricting the amount of developer carried to said detection station.

2. A toner concentration detecting device as claimed in claim 1, wherein said restriction means comprises a restriction member disposed a predetermined distance from a peripheral surface of said detection roll to thereby restrict the thickness of developed toner adhered to said detection roll.

3. A toner concentration detecting device as claimed in claim 1, further comprising cleaning means adjacent said detection roll between said detection station and said flowpath for cleaning the circumferential peripheral surface of said detection roll.

4. A toner concentration detecting device as claimed in claim 3, wherein said cleaning means abuts the peripheral surface of said detection roll between said detection station and said flowpath to scrape said developed toner from said detection roll.

5. A toner concentration detecting device as claimed in claim 1, wherein said magnet is a permanent magnet.

6. A toner concentration detecting device as claimed in claim 1, wherein said detection station comprises a conductive glass member adjacent said detection roll and means for detecting the developer adhered to said detection roll through said conductive glass member.

7. A toner concentration detecting device as claimed in claim 4, wherein said detection roll comprises an inner roll having first and second peripheral portions, said first peripheral portion comprising a non-magnetic material and said second peripheral portion comprising said magnet, and wherein said sleeve comprises a non-magnetic outer covering over both of said first and second peripheral portions.

* * * * *